US011636821B2

(12) United States Patent
Ha et al.

(10) Patent No.: US 11,636,821 B2
(45) Date of Patent: Apr. 25, 2023

(54) GATE DRIVING CIRCUIT AND DISPLAY DEVICE INCLUDING THE SAME

(71) Applicant: Samsung Display Co., Ltd., Yongin-si (KR)

(72) Inventors: Tae-Seok Ha, Hwaseong-si (KR); Kyoungsoo Kim, Suwon-si (KR); Kyu-Jin Park, Cheonan-si (KR); Seung-Woon Shin, Asan-si (KR); Woon-Rok Jang, Cheonan-si (KR); In-Won Jin, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/170,720

(22) Filed: Feb. 8, 2021

(65) Prior Publication Data

US 2021/0375229 A1 Dec. 2, 2021

(30) Foreign Application Priority Data

May 26, 2020 (KR) ..... 10-2020-0063201

(51) Int. Cl.
*G09G 3/36* (2006.01)

(52) U.S. Cl.
CPC ..... *G09G 3/3696* (2013.01); *G09G 3/3688* (2013.01); *G09G 2310/08* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,466,312 | B2 | 12/2008 | Choi et al. | |
| 8,553,027 | B2 | 10/2013 | Kim et al. | |
| 8,982,115 | B2 | 3/2015 | Sung et al. | |
| 10,672,357 | B2 * | 6/2020 | Lee | G09G 3/3677 |
| 2005/0104647 | A1 * | 5/2005 | Choi | G06F 1/04 327/333 |
| 2015/0356909 | A1 * | 12/2015 | Lim | H03K 17/162 327/109 |
| 2018/0130435 | A1 * | 5/2018 | Lee | G09G 3/3677 |
| 2021/0375229 | A1 * | 12/2021 | Ha | G09G 3/3688 |

FOREIGN PATENT DOCUMENTS

| | | |
|---|---|---|
| KR | 10-0555528 | 3/2006 |
| KR | 10-1469096 | 12/2014 |
| KR | 10-1925993 | 12/2018 |

* cited by examiner

*Primary Examiner* — Van N Chow
(74) *Attorney, Agent, or Firm* — H.C. Park & Associates, PLC

(57) ABSTRACT

A gate driving circuit includes: a plurality of driving stages, each driving stage configured to provide a gate signal to a corresponding gate line among a plurality of gate lines, wherein each of the plurality of driving stages includes: a first transistor electrically connected between a first clock terminal and a gate output terminal, the first transistor including a gate electrode electrically connected to a first node, the first clock terminal to receive a first clock signal; a second transistor configured to transmit a first carry signal to the first node; and a third transistor electrically connected between the first node and a first voltage terminal, the third transistor including a gate electrode electrically connected to the first voltage terminal, the first voltage terminal to receive a first voltage, wherein the gate output terminal is electrically connected to the corresponding gate line.

15 Claims, 7 Drawing Sheets

GATE DRIVING CIRCUIT AND DISPLAY DEVICE INCLUDING THE SAME

CROSS-REFERENCE TO RELATED APPLICATION

This application claims priority from and the benefit of Korean Patent Application No. 10-2020-0063201, filed on May 26, 2020, which is hereby incorporated by reference for all purposes as if fully set forth herein.

BACKGROUND

Field

Exemplary implementations of the invention relate generally to a display device, and more particularly, to a display device including a gate driving circuit.

Discussion of the Background

In general, a display device includes a display panel for displaying an image and a driving circuit for driving the display panel. The display panel includes a plurality of gate lines, a plurality of data lines, and a plurality of pixels. Each of the pixels is connected to a corresponding gate line among the plurality of gate lines and a corresponding data line among the plurality of data lines. The driving circuit includes a data driving circuit for outputting data signals to the data lines, a gate driving circuit for outputting gate signals for driving the gate lines, a voltage generating circuit for providing clock signals to the gate driving circuit, and a timing controller for controlling the data driving circuit and the gate driving circuit. The voltage generating circuit may generate the clock signals and voltages according to control by the timing controller.

When the driving circuit is powered up, the timing controller performs an initialization operation. In this case, a noise image may be displayed on the display device when the gate lines have a floating state.

The above information disclosed in this Background section is only for understanding of the background of the inventive concepts, and, therefore, it may contain information that does not constitute prior art.

SUMMARY

Applicants discovered that when a display device is powered up, the display device displays a noise image due to floating states of gate lines of the display device.

Display devices constructed according to the principles and exemplary implementations of the invention are capable of preventing or minimizing noise images due to floating states of gate lines of the display devices by discharging the gate lines.

Display devices constructed according to the principles and exemplary implementations of the invention are capable of stably operating when powered up by providing a gate driving circuit for preventing the floating states of the gate lines of the display devices.

Additional features of the inventive concepts will be set forth in the description which follows, and in part will be apparent from the description, or may be learned by practice of the inventive concepts.

According to one or more exemplary embodiments of the invention, a gate driving circuit includes: a plurality of driving stages, each of the plurality of driving stages configured to provide a gate signal to a corresponding gate line among a plurality of gate lines, wherein each of the plurality of driving stages includes: a first transistor electrically connected between a first clock terminal and a gate output terminal, the first transistor including a gate electrode electrically connected to a first node, the first clock terminal to receive a first clock signal; a second transistor configured to transmit a first carry signal to the first node; and a third transistor electrically connected between the first node and a first voltage terminal, the third transistor including a gate electrode electrically connected to the first voltage terminal, the first voltage terminal to receive a first voltage, wherein the gate output terminal is electrically connected to the corresponding gate line.

The first voltage may be changed from a first level to a second level different from the first level during an initialization mode.

The first voltage may be changed to sequentially have a first level, a second level different from the first level, and the first level during an initialization mode.

The first clock signal may have a low level during the initialization mode.

The third transistor may be configured to transmit the first voltage to the first node when the first voltage has the second level.

Each of the plurality of driving stages may further include a fourth transistor connected between the gate output terminal and a second voltage terminal for receiving a second voltage, the fourth transistor including a gate electrode connected to a second clock terminal for receiving a second clock signal.

Each of the plurality of driving stages may further include a fifth transistor connected between the first clock terminal and a carry output terminal, the fifth transistor including a gate electrode connected to the first node, and the carry output terminal may be configured to outputs a carry signal.

According to one or more exemplary embodiments of the invention, a display device includes: a display panel including a plurality of pixels respectively connected to a plurality of data lines and respectively connected to a plurality of gate lines; a data driving circuit configured to drive the plurality of data lines; a gate driving circuit configured to drive the plurality of gate lines; a timing controller configured to receive an image signal and a control signal, control the data driving circuit and the gate driving circuit to display an image on the display panel, and output a gate pulse signal; and a voltage generating circuit configured to output a first clock signal and a first voltage in response to the gate pulse signal, wherein the voltage generating circuit is configured to change the first voltage such that the first voltage sequentially has a first level and a second level different from the first level during an initialization mode, and the gate driving circuit includes a plurality of driving stages, each of the plurality of driving stages configured to provide a gate signal to a corresponding gate line among the plurality of gate lines, wherein each of the plurality of driving stages is configured to discharge the corresponding gate line in response to the first voltage and the first clock signal in the initialization mode.

The first voltage may be changed to sequentially have the first level, the second level, and the first level during the initialization mode.

Each of the plurality of driving stages may include: a first transistor connected between a first clock terminal for receiving the first clock signal and a gate output terminal, the first transistor including a gate electrode connected to a first node; a second transistor configured to transmit a first carry signal to the first node; and a third transistor connected between the first node and a first voltage terminal for receiving the first voltage, the third transistor including a gate electrode connected to the first voltage terminal.

The third transistor may be configured to transmit the first voltage to the first node when the first voltage has the second level.

The voltage generating circuit may be further configured to generate a second clock signal different from the first clock signal and a second voltage different from the first voltage.

Each of the plurality of driving stages may further include a fourth transistor connected between the gate output terminal and a second voltage terminal for receiving the second voltage, the fourth transistor including a gate electrode connected to a second clock terminal for receiving the second clock signal.

The voltage generating circuit may be configured to maintain the first clock signal and the second clock signal at a low level during the initialization mode.

The voltage generating circuit may be configured to maintain the second voltage at the first level during the initialization mode.

Each of the plurality of driving stages may further include a fourth transistor connected between the gate output terminal and a second voltage terminal for receiving a second voltage, the fourth transistor including a gate electrode connected to a second clock terminal for receiving a second clock signal.

Each of the plurality of driving stages may further include a fifth transistor connected between the first clock terminal and a carry output terminal, the fifth transistor including a gate electrode connected to the first node, and the carry output terminal is configured to output a carry signal.

The carry signal outputted from a j-th driving stage among the plurality of driving stages may be provided to a carry input terminal of a (j+1)-th driving stage, wherein, j is a natural number.

The timing controller may be configured to provide a start signal to the gate driving circuit during a driving mode.

A first driving stage among the plurality of driving stages of the gate driving circuit may be configured to receive the start signal through a carry input terminal.

It is to be understood that both the foregoing general description and the following detailed description are exemplary and explanatory and are intended to provide further explanation of the invention as claimed.

BRIEF DESCRIPTION OF THE FIGURES

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
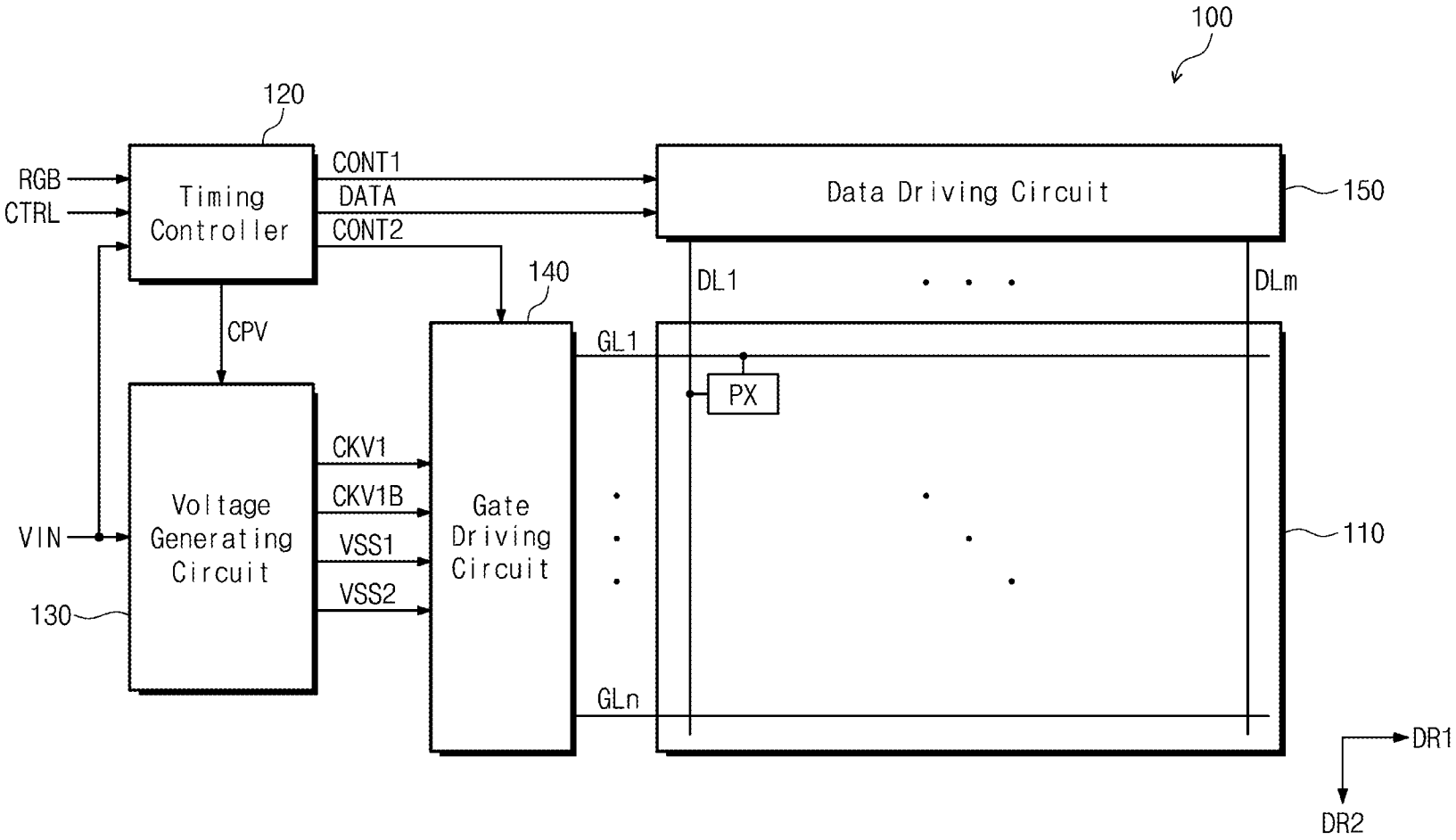
FIG. 1 is a block diagram illustrating a configuration of an exemplary embodiment of a display device constructed according to the principles of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the DR1-axis, the DR2-axis, and the DR3-axis are not limited to three axes of a rectangular coordinate system, such as the x, y, and z-axes, and may be interpreted in a broader sense. For example, the DR1-axis, the DR2-axis, and the DR3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram illustrating a configuration of an exemplary embodiment of a display device constructed according to the principles of the invention.

Referring to FIG. 1, a display device 100 according to an exemplary embodiment includes a display panel 110, a timing controller 120, a voltage generating circuit 130, a gate driving circuit 140, and a data driving circuit 150.

The display panel 110 is not particularly limited and may include various display panels such as a liquid crystal display panel, an organic light emitting display panel, an electrophoretic display panel, and an electrowetting display panel. In the case where the display panel 110 is a liquid crystal display panel, the display device 100 may further include a polarizer, a backlight unit, and the like.

The display panel 110 includes pixels PX, a plurality of gate lines GL1 to GLn, and a plurality of data lines DL1 to DLm crossing the gate lines GL1 to GLn (wherein, n and m are natural numbers greater than 2). The plurality of gate lines GL1 to GLn are connected to the gate driving circuit 140. The plurality of data lines DL1 to DLm are connected to the data driving circuit 150. Only some of the plurality of gate lines GL1 to GLn and some of the plurality of data lines DL1 to DLm are illustrated in FIG. 1.

Although only one of the plurality of pixels PX is illustrated in FIG. 1, the display panel 110 includes the plurality of pixels PX. Each of the plurality of pixels PX is connected to a corresponding gate line among the plurality of gate lines GL1 to GLn and a corresponding data line among the plurality of data lines DL1 to DLm.

The timing controller 120 receives image data RGB and a control signal CTRL from an external graphic control unit. The control signal CTRL may include a vertical synchronization signal, a horizontal synchronization signal, a data enable signal, and clock signals.

The timing controller 120 receives the image data RGB and the control signal CTRL, and outputs a data signal DATA and a data control signal CONT1 to be provided to the data driving circuit 150, a gate control signal CONT2 to be provided to the gate driving circuit 140, and a gate pulse signal CPV to be provided to the voltage generating circuit 130. The timing controller 120 may receive an input voltage VIN from the outside.

The voltage generating circuit 130 receives the gate pulse signal CPV from the timing controller 120 and generates a first clock signal CKV1 and a second clock signal CKV1B.

The first clock signal CKV1 and the second clock signal CKV1B may be signals having the same frequency and different phases. Although, in the following description, the voltage generating circuit 130 is described as outputting the two clock signals CKV1 and CKV1B as an example, the number of clock signals may be variously changed according to a configuration of the gate driving circuit 140.

The voltage generating circuit 130 may be implemented with a power management integrated circuit (PMIC). In addition to the first clock signal CKV1 and the second clock signal CKV1B, the voltage generating circuit 130 may further generate a first voltage VSS1 and a second voltage VSS2, which are used for the operation of the gate driving circuit 140. A common voltage, a power supply voltage, a ground voltage, and the like, which are used for the operation of the display panel 110, may further be generated by the voltage generating circuit 130.

The voltage generating circuit 130 may receive the input voltage VIN from the outside. The voltage generating circuit 130 according to an exemplary embodiment may set the first clock signal CKV1, the second clock signal CKV1B, and the first voltage VSS1 to a low level (e.g., about 0 V or less) during an initialization mode after supply of the input voltage VIN is started. The voltage generating circuit 130 may sequentially set the second voltage VSS2 to a first level (e.g., about −7 V), a second level, and the first level during the initialization mode. The operation of the voltage generating circuit 130 will be described in detail later.

The gate driving circuit 140 generates gate signals and outputs the gate signals to the plurality of gate lines GL1 to GLn based on the gate control signal CONT2, which is received from the timing controller 120, and based on the first clock signal CKV1, the second clock signal CKV1B, the first voltage VSS1, and the second voltage VSS2, which are received from the voltage generating circuit 130.

The gate driving circuit 140 may be formed simultaneously with the pixels PX through a thin film process. For example, the gate driving circuit 140 may be disposed in a predetermined area (e.g., a non-display area in which the pixels PX are not arranged) of the display panel 110. In another exemplary embodiment, a gate driving circuit 140 may include a driving chip and a flexible circuit board mounted with the driving chip, and the flexible circuit board may be electrically connected to a display panel 110. In another exemplary embodiment, a gate driving circuit 140 may be mounted on a non-display area of a display panel 110 by a chip on glass (COG) method.

The data driving circuit 150 generates gradation voltages according to the data signal DATA provided from the timing controller 120 based on the data control signal CONT1 received from the timing controller 120. The data driving circuit 150 outputs the gradation voltages to the plurality of data lines DL1 to DLm.

Figure 2:
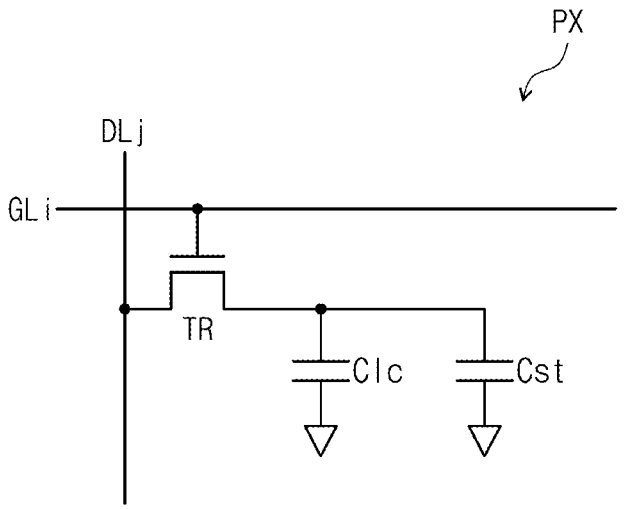
FIG. 2 is an equivalent circuit diagram of each of representative pixels of the display device of FIG. 1.

FIG. 2 is an equivalent circuit diagram of each of representative pixels of the display device of FIG. 1.

As illustrated in FIG. 2, each of the pixels PX includes a thin film transistor TR (hereinafter referred to as a pixel transistor TR), a liquid crystal capacitor Clc, and a storage capacitor Cst. In another exemplary embodiment, the storage capacitor Cst may be omitted.

The pixel transistor TR is electrically connected to an i-th gate line GLi and a j-th data line DLj (wherein, i and j are natural numbers). The pixel transistor TR transmits, to the liquid crystal capacitor Clc, a pixel voltage corresponding to a data signal received from the j-th data line DLj in response to a gate signal received from the i-th gate line GLi.

The liquid crystal capacitor Clc is charged to the pixel voltage transmitted from the pixel transistor TR. Alignment of a liquid crystal director of a liquid crystal layer of the liquid crystal capacitor Clc may change according to the amount of electric charge charged in the liquid crystal capacitor Clc. According to the alignment of the liquid crystal director, light incident on the liquid crystal layer may be transmitted or blocked to display an image.

The storage capacitor Cst is connected in parallel to the liquid crystal capacitor Clc. The storage capacitor Cst may maintain the alignment of the liquid crystal director for a certain period of time.

Figure 3A:
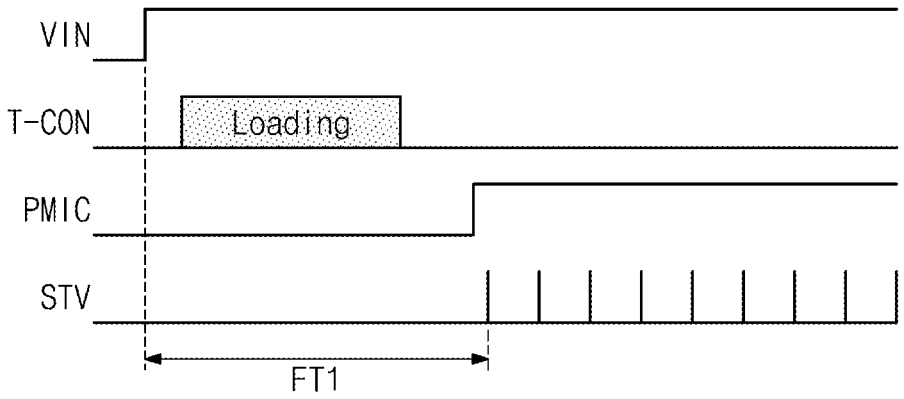
FIG. 3A and FIG. 3B are timing diagrams for illustrating an operation of the display device of FIG. 1.
Figure 3B:
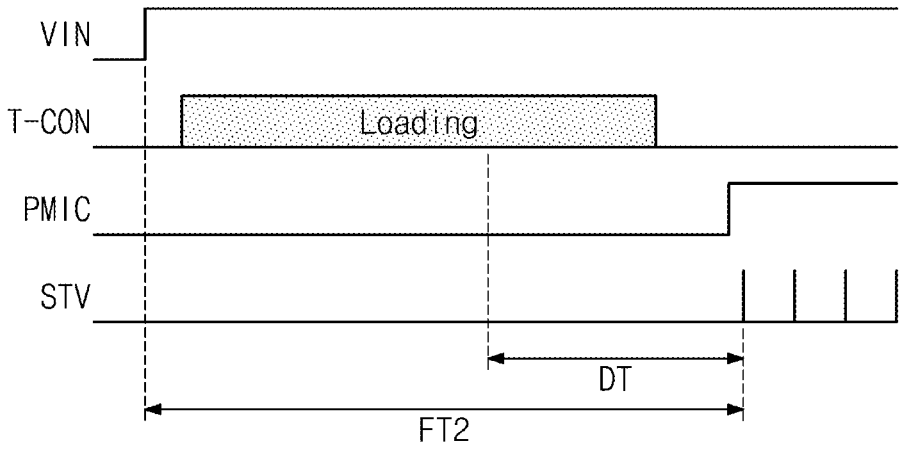

FIG. 3A and FIG. 3B are timing diagrams for illustrating an operation of the display device of FIG. 1.

Referring to FIGS. 1, 3A, and 3B, the timing controller 120 performs an initialization operation when the supply of the input voltage VIN is started. For example, the timing controller 120 (denoted as "T-CON" in FIGS. 3A and 3B) may perform a loading operation that sets state information such as an operating frequency and an operating voltage level and sets an interface with the data driving circuit 150 based on the control signal CTRL provided from the outside and state information stored in internal memory (or a lookup table). The loading operation may include a training mode. In the training mode, the timing controller 120 may check the interface with the data driving circuit 150 by transmitting a clock training signal to the data driving circuit 150 and by receiving a lock signal from the data driving circuit 150.

When the timing controller 120 transmits the gate pulse signal CPV to the voltage generating circuit 130 (denoted as "PMIC" in FIGS. 3A and 3B) after the loading operation of the timing controller 120 is completed, the voltage generating circuit 130 starts an operation. The voltage generating circuit 130 may generate the first clock signal CKV1, the second clock signal CKV1B, the first voltage VSS1, and the second voltage VSS2 in response to the gate pulse signal CPV received from the timing controller 120.

For example, the timing controller 120 outputs the gate control signal CONT2 to the gate driving circuit 140 after the loading operation is completed. The gate control signal CONT2 may include a start signal STV indicating a start of one frame.

The gate driving circuit 140 may output the gate signals to the gate lines GL1 to GLn in response to the start signal STV included in the gate control signal CONT2 from the timing controller 120 and the first clock signal CKV1, the second clock signal CKV1B, the first voltage VSS1, and the second voltage VSS2 from the voltage generating circuit 130.

As illustrated in FIG. 3A, the time gap between a start of the supply of the input voltage VIN and an output of a first pulse of the start signal STV is a first time FT1.

Recently, as functions of the timing controller 120 become diversified and the size of the lookup table is increased, the time required for the loading operation of the timing controller 120 is increased. Accordingly, as illustrated in FIG. 3B, the time gap between the start of the supply of the input voltage VIN and the output of the first pulse of the start signal STV is a second time FT2. The second time FT2 illustrated in FIG. 3B is longer by a delay time DT than the first time FT1 illustrated in FIG. 3A.

The gate lines GL1 to GLn may be maintained in a floating state until the first pulse of the start signal STV is outputted after the supply of the input voltage VIN is started.

That is, the first time FT1 and the second time FT2 may mean floating times during which the gate lines GL1 to GLn are maintained in the floating state.

As described with reference to FIG. 2, a gate electrode of the pixel transistor TR is connected to the i-th gate line GLi. When a floating voltage level of the i-th gate line GLi is a predetermined level or higher, the pixel transistor TR may be turned on such that an unwanted noise image may be displayed on the display panel 110.

Figure 4:
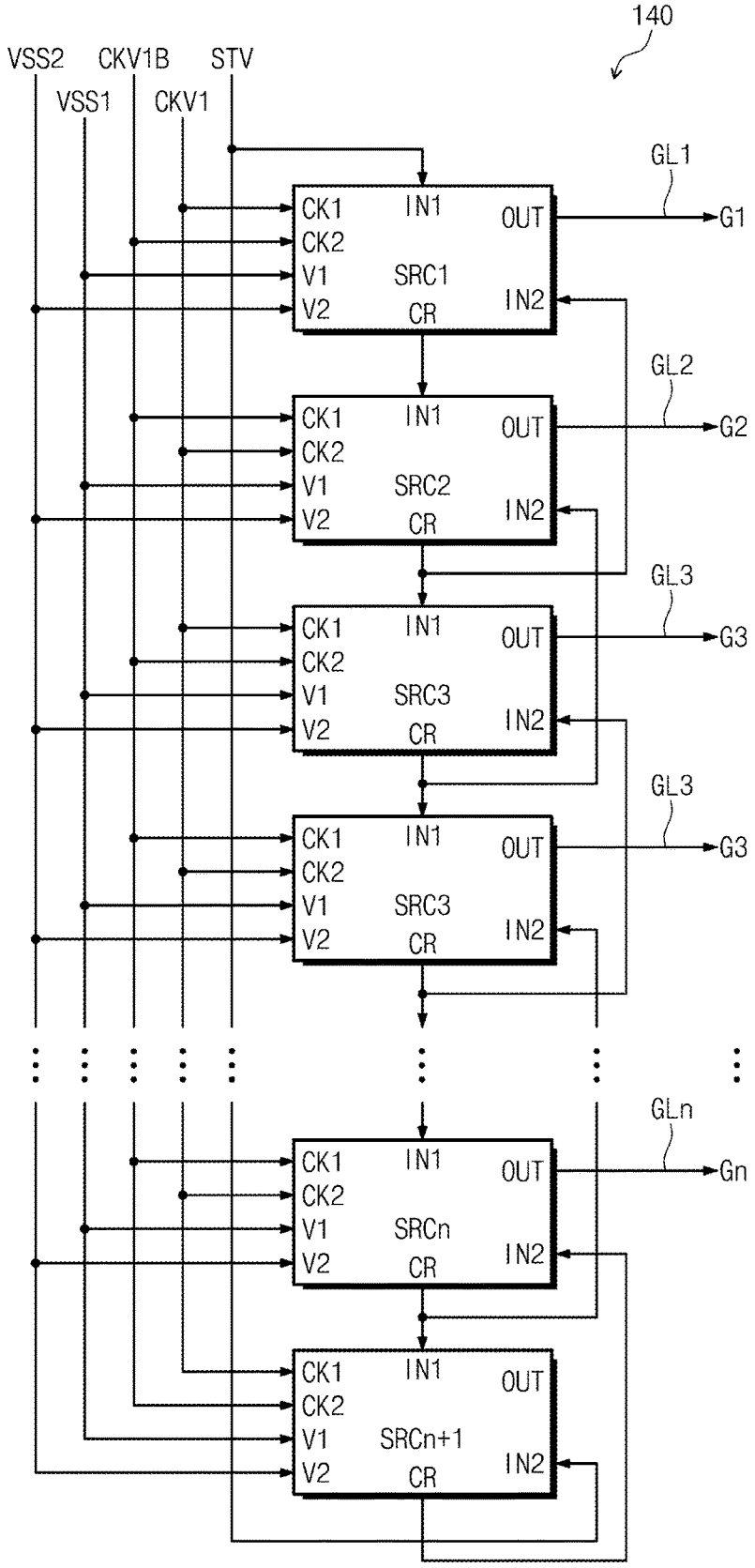
FIG. 4 is a block diagram exemplarily illustrating a configuration of a gate driving circuit of the display device of FIG. 1.

FIG. 4 is a block diagram exemplarily illustrating a configuration of a gate driving circuit of the display device of FIG. 1.

Referring to FIG. 4, the gate driving circuit 140 includes a plurality of driving stages SRC1 to SRCn and a dummy driving stage SRCn+1. The plurality of driving stages SRC1 to SRCn and the dummy driving stage SRCn+1 have a mutually dependent connection relationship that operates in response to a carry signal outputted from a previous stage and a carry signal outputted from a next stage.

Each of the plurality of driving stages SRC1 to SRCn and the dummy driving stage SRCn+1 receives the first clock signal CKV1 and the second clock signal CKV1B from the voltage generating circuit 130 illustrated in FIG. 1. The driving stage SRC1 and the dummy driving stage SRCn+1 further receive the start signal STV.

Although, in the example illustrated in FIG. 4, the gate driving circuit 140 receives only two clock signals, e.g., the first clock signal CKV1 and the second clock signal CKV1B, exemplary embodiments are not limited thereto. For example, the voltage generating circuit 130 may generate 4 clock signals, 8 clock signals, 12 clock signals, or 16 clock signals different from each other, and the plurality of driving stages SRC1 to SRCn and the dummy driving stage SRCn+1 in the gate driving circuit 140 may receive some corresponding clock signals among the 4 clock signals, 8 clock signals, 12 clock signals, or 16 clock signals.

In this exemplary embodiment, the plurality of driving stages SRC1 to SRCn are electrically connected to the plurality of gate lines GL1 to GLn, respectively. The plurality of driving stages SRC1 to SRCn respectively provide gate signals G1 to Gn to the plurality of gate lines GL1 to GLn.

Each of the driving stages SRC1 to SRCn and the dummy driving stage SRCn+1 includes a first carry input terminal IN1, a second carry input terminal IN2, a gate output terminal (as an output terminal) OUT, a carry output terminal CR, a first clock terminal CK1, a second clock terminal CK2, a first voltage terminal V1, and a second voltage terminal V2.

The gate output terminal OUT of each of the driving stages SRC1 to SRCn is electrically connected to a corresponding gate line among the plurality of gate lines GL1 to GLn. The gate signals G1 to Gn generated from the driving stages SRC1 to SRCn may be provided to the gate lines GL1 to GLn through the gate output terminals OUT.

The carry output terminal CR of each of the driving stages SRC1 to SRCn is electrically connected to the first carry input terminal IN1 of the next driving stage of a corresponding driving stage. In addition, the carry output terminal CR of each of the driving stages SRC2 to SRCn and the dummy driving stage SRCn+1 is electrically connected to the second carry input terminal IN2 of the previous driving stage. For example, the carry output terminal CR of a k-th driving stage SRCk among the driving stages SRC1 to SRCn is connected to the second carry input terminal IN2 of a (k−1)-th driving stage SRCk-1 and the first carry input terminal IN1 of a (k+1)-th driving stage SRCk+1. In an exemplary embodiment, the carry output terminal CR of the k-th driving stage SRCk among the driving stages SRC1 to SRCn may be connected to the second carry input terminal IN2 of the (k−1)-th driving stage SRCk-1 and the first carry input terminal IN1 of a (k+s)-th driving stage SRCk+s (here, each of k and s is a natural number). For example, the carry output terminal CR of the k-th driving stage SRCk among the driving stages SRC1 to SRCn may be connected to the second carry input terminal IN2 of the (k−1)-th driving stage SRCk-1 and the first carry input terminal IN1 of a (k+4)-th driving stage SRCk+4.

The first carry input terminal IN1 of each of the driving stages SRC2 to SRCn and the dummy driving stage SRCn+1 receives a carry signal outputted from the previous driving stage. For example, the first carry input terminal IN1 of the k-th driving stage SRCk receives a carry signal CRk−1 outputted from the (k−1)-th driving stage SRCk−1. The first carry input terminal IN1 of a first driving stage SRC1 among the driving stages SRC1 to SRCn receives the start signal STV included in the gate control signal CONT2 provided from the timing controller 120 illustrated in FIG. 1.

The second carry input terminal IN2 of each of the driving stages SRC1 to SRCn receives a carry signal from the carry output terminal CR of the next driving stage. For example, the second carry input terminal IN2 of the k-th driving stage SRCk receives a carry signal CRk+1 outputted from the carry output terminal CR of the (k+1)-th driving stage SRCk+1. The second carry input terminal IN2 of the dummy driving stage SRCn+1 receives the start signal STV included in the gate control signal CONT2 provided from the timing controller 120 illustrated in FIG. 1.

In another exemplary embodiment, a second carry input terminal IN2 of each of driving stages SRC1 to SRCn-1 may be electrically connected to a gate output terminal OUT of the next driving stage. The second carry input terminal IN2 of an n-th driving stage SRCn receives a carry signal CRn+1 outputted from a carry output terminal CR of a dummy driving stage SRCn+1. A second carry input terminal IN2 of the dummy driving stage SRCn+1 receives a start signal STV included in a gate control signal CONT2 provided from a timing controller 120 illustrated in FIG. 1.

The first clock terminal CK1 and the second clock terminal CK2 of each of the driving stages SRC1 to SRCn and the dummy driving stage SRCn+1 respectively receive the first clock signal CKV1 or the second clock signal CKV1B. The first clock terminals CK1 of odd-numbered driving stages SRC1, SRC3, . . . , SRCn+1 may each receive the first clock signal CKV1, and the second clock terminals CK2 of odd-numbered driving stages SRC1, SRC3, . . . , SRCn+1 may each receive the second clock signal CKV1B. The first clock terminals CK1 of even-numbered driving stages SRC2, SRC4, . . . , SRCn may each receive the second clock signal CKV1B, and the second clock terminals CK2 of the even-numbered driving stages SRC2, SRC4, . . . , SRCn may each receive the first clock signal CKV1.

The first voltage terminal V1 of each of the driving stages SRC1 to SRCn and the dummy driving stage SRCn+1 receives the first voltage VSS1. The second voltage terminal V2 of each of the driving stages SRC1 to SRCn and the dummy driving stage SRCn+1 receives the second voltage VSS2. The first voltage VSS1 and the second voltage VSS2 may have different voltage levels, and the second voltage VSS2 may have a lower voltage level than the first voltage VSS1.

In an exemplary embodiment, each of the driving stages SRC1 to SRCn and the dummy driving stage SRCn+1, according to a circuit configuration thereof, may omit any one of the first carry input terminal IN1, the second carry input terminal IN2, the gate output terminal OUT, the carry output terminal CR, the first clock terminal CK1, the second clock terminal CK2, the first voltage terminal V1, and the second voltage terminal V2, or may further include other terminals. For example, any one of the first voltage terminal V1 and the second voltage terminal V2 may be omitted. In this case, each of the driving stages SRC1 to SRCn and the dummy driving stage SRCn+1 receives only one of the first voltage VSS1 and the second voltage VSS2. In addition, the connection relationship between the driving stages SRC1 to SRCn and the dummy driving stage SRCn+1 may also be changed.

Figure 5:
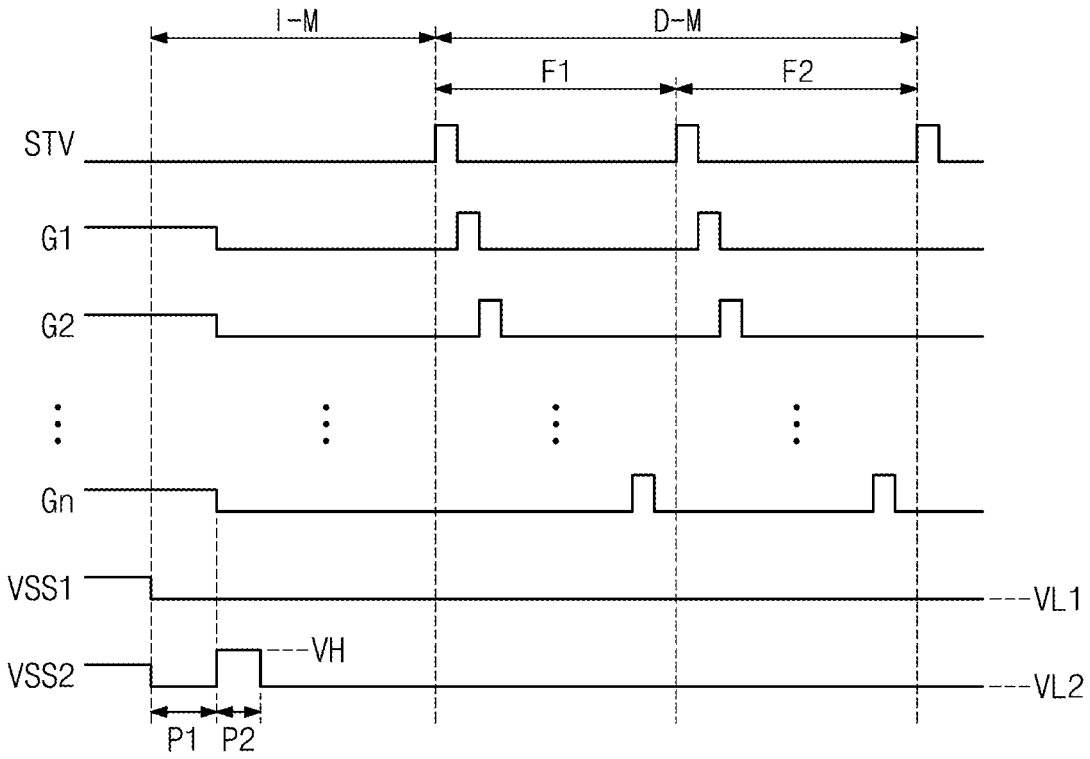
FIG. 5 is a timing diagram exemplarily illustrating an operation of the gate driving circuit of the display device of FIG. 1.

FIG. 5 is a timing diagram exemplarily illustrating an operation of the gate driving circuit of the display device of FIG. 1.

Referring to FIGS. 1, 4, and 5, the voltage generating circuit 130 operates in an initialization mode I-M when the supply of the input voltage VIN is started. In the initialization mode I-M, the voltage generating circuit 130 outputs the first voltage VSS1 and the second voltage VSS2 having predetermined levels, respectively. For example, the first voltage VSS1 may has a first low voltage level VL1, and the second voltage VSS2 may has a second low voltage level VL2. In an exemplary embodiment, the first low voltage level VL1 and the second low voltage level VL2 may be the same as each other. In an exemplary embodiment, the second low voltage level VL2 may be lower than the first low voltage level VL1.

The voltage generating circuit 130 maintains the second voltage VSS2 at the second low voltage level VL2 during a first period P1 of the initialization mode I-M and changes the second voltage VSS2 to a high voltage level VH higher than the second low voltage level VL2 during a second period P2. The voltage generating circuit 130 may change the second voltage VSS2 to the second low voltage level VL2 after the second period P2 of the initialization mode I-M.

The driving stages SRC1 to SRCn in the gate driving circuit 140 may respectively maintain the gate signals G1 to Gn to have a low level in response to a second voltage VSS2 of the high voltage level VH in the second period P2 of the initialization mode I-M.

When the initialization mode I-M is ended and a driving mode D-M is started, the timing controller 120 may provide the start signal STV to the gate driving circuit 140. Also, the voltage generating circuit 130 may provide the first clock signal CKV1 and the second clock signal CKV1B to the gate driving circuit 140 when the driving mode D-M is started.

The driving stages SRC1 to SRCn may sequentially activate the gate signals G1 to Gn, respectively, to a high level in response to the start signal STV, the first clock signal CKV1, and the second clock signal CKV1B.

Figure 6:
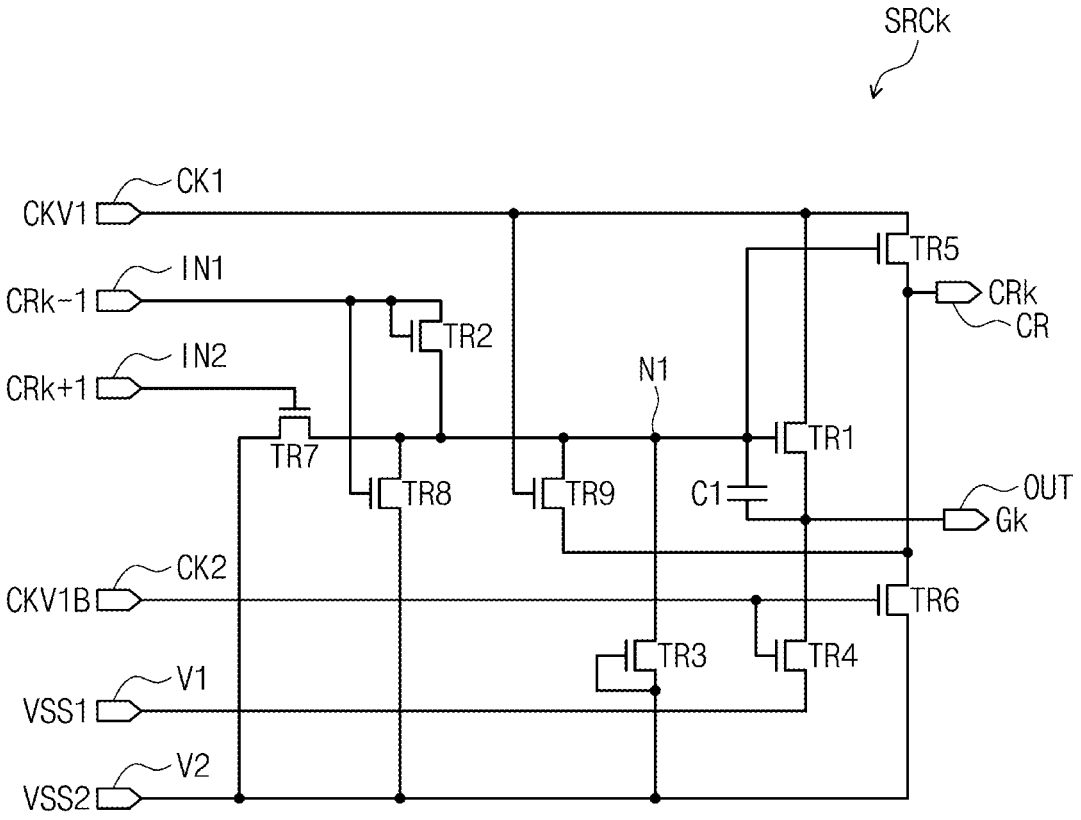
FIG. 6 is a circuit diagram of a driving stage in the gate driving circuit of FIG. 4.

FIG. 6 is a circuit diagram of the k-th driving stage (here, k is a natural number) in the gate driving circuit 140 illustrated in FIG. 4. Each of the plurality of driving stages SRC1 to SRCn and the dummy driving stage SRCn+1 illustrated in FIG. 4 may have the same circuit as the k-th driving stage SRCk. Hereinafter, the k-th driving stage SRCk is referred to as a driving stage SRCk.

Referring to FIG. 6, the driving stage SRCk includes the first carry input terminal IN1, the second carry input terminal IN2, the gate output terminal OUT as the output terminal, the carry output terminal CR, the first clock terminal CK1, the second clock terminal CK2, the first voltage terminal V1, the second voltage terminal V2, first to ninth transistors TR1 to TR9, and a capacitor C1.

The first transistor TR1 is connected between the first clock terminal CK1 and the gate output terminal OUT and includes a gate electrode connected to a first node N1.

The second transistor TR2 is connected between the first carry input terminal IN1 and the first node N1 and includes a gate electrode connected to the first carry input terminal IN1.

The third transistor TR3 is connected between the first node N1 and the second voltage terminal V2 and includes a gate electrode connected to the second voltage terminal V2.

The fourth transistor TR4 is connected between the gate output terminal OUT and the first voltage terminal V1 and includes a gate electrode connected to the second clock terminal CK2.

The fifth transistor TR5 is connected between the first clock terminal CK1 and the carry output terminal CR and includes a gate electrode connected to the first node N1.

The sixth transistor TR6 is connected between the carry output terminal CR and the second voltage terminal V2 and includes a gate electrode connected to the second clock terminal CK2.

The seventh transistor TR7 is connected between the first node N1 and the second voltage terminal V2 and includes a gate electrode connected to the second carry input terminal IN2.

The eighth transistor TR8 is connected between the first node N1 and the second voltage terminal V2 and includes a gate electrode connected to the first carry input terminal IN1.

The ninth transistor TR9 is connected between the first node N1 and the carry output terminal CR and includes a gate electrode connected to the first clock terminal CK1.

The capacitor C1 is connected between the first node N1 and the gate output terminal OUT.

Although the driving stage SRCk including the first to ninth transistors TR1 to TR9 and the one capacitor C1 is illustrated in FIG. 6, the circuit configuration of the driving stage SRCk may be variously changed. For example, the eighth transistor TR8 may include two transistors which are connected in series between the first node N1 and the second voltage terminal V2. Each of the two transistors of the eighth transistor TR8 has a gate electrode connected to the first carry input terminal IN1. For example, the fourth transistor TR4 may include two transistors which are connected in parallel between the gate output terminal OUT and the first voltage terminal V1. Each of the two transistors of the fourth transistor TR4 has a gate electrode connected to the second clock terminal CK2.

Figure 7:
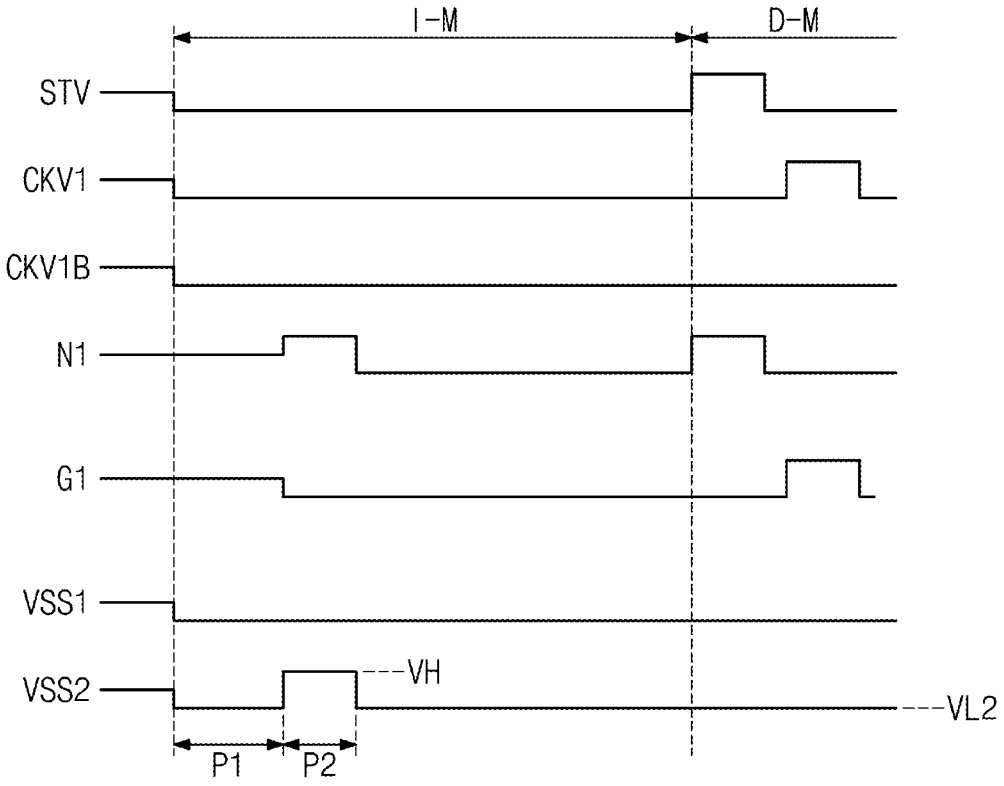
FIG. 7 is a timing diagram for illustrating an operation of the driving stage of FIG. 6.

FIG. 7 is a timing diagram for illustrating an operation of the driving stage SRCk illustrated in FIG. 6.

Referring to FIGS. 1, 6, and 7, when the supply of the input voltage VIN is started, the voltage generating circuit 130 does not yet generate the first clock signal CKV1, the second clock signal CKV1B, the first voltage VSS1, and the second voltage VSS2. Accordingly, the first clock signal CKV1, the second clock signal CKV1B, the first voltage VSS1, and the second voltage VSS2 may be each in the floating state. Also, the start signal STV included in the gate control signal CONT2 outputted from the timing controller 120 may be in the floating state.

When the supply of the input voltage VIN is started, the voltage generating circuit 130 operates in the initialization mode I-M. During the initialization mode I-M, the voltage generating circuit 130 sets the first clock signal CKV1, the second clock signal CKV1B, the first voltage VSS1, and the second voltage VSS2 to predetermined levels (e.g., low levels), respectively. For example, the predetermined levels may be voltages of about 0 V or lower.

The voltage generating circuit 130 sets the second voltage VSS2 to the second low voltage level VL2 during the first period P1 in the initialization mode I-M. The third transistor TR3 in the driving stage SRCk is turned off while the second voltage VSS2 has the second low voltage level VL2.

The voltage generating circuit 130 sets the second voltage VSS2 to the high voltage level VH during the second period P2 in the initialization mode I-M. The third transistor TR3 in the driving stage SRCk is turned on while the second voltage VSS2 is at the high voltage level VH. As the third transistor TR3 is turned on, the second voltage VSS2 of the high voltage level VH is transmitted to the first node N1. When the voltage level of the first node N1 rises to the high voltage level VH, the first transistor TR1 is turned on. At this time, the output terminal OUT may be discharged through the first clock terminal CK1 because the first clock signal CKV1 is at the low level. As a result, the gate signal G1 may be maintained at the low level.

Because the pixel transistor TR (see FIG. 2) of the pixel PX in the display panel 110 is maintained in a turn-off state when the gate signal G1 is at the low level, an unwanted image may be prevented from being displayed on the display panel 110 during the initialization mode I-M.

The voltage generating circuit 130 sets the second voltage VSS2 to the high voltage level VH during the second period P2 in the initialization mode I-M, and changes the second voltage VSS2 to the second low voltage level VL2 when the second period P2 is ended. For example, during the initialization mode I-M, the second voltage VSS2 may sequentially have the second low voltage level VL2 (e.g., the first level), the high voltage level VH (e.g., the second level higher than the first level), and the second low voltage level VL2 (e.g., the first level). The high voltage level VH may have the same voltage level as high level voltages of the first clock signal CKV1 and the second clock signal CKV1B. In an exemplary embodiment, the high voltage level VH may have the same voltage level as the input voltage VIN.

When the loading operation of the timing controller 120 is ended and the driving mode D-M is started, the timing controller 120 outputs the start signal STV. The voltage generating circuit 130 generates the first clock signal CKV1, the second clock signal CKV1B, the first voltage VSS1, and the second voltage VSS2 in the driving mode D-M.

The gate driving circuit 140 may sequentially activate the gate signals G1 to Gn to the high level for each of frames F1 and F2 (refer to FIG. 5) in response to the start signal STV, the first clock signal CKV1, the second clock signal CKV1B, the first voltage VSS1, and the second voltage VSS2.

During the driving mode D-M, the third transistor TR3 in the driving stage SRCk is turned off because the second voltage VSS2 is maintained at the second low voltage level VL2. Accordingly, the voltage level of the first node N1 may be determined according to the carry signals CRk−1 and CRk+1. For example, the third transistor TR3 may be turned on only while the second voltage VSS2 is at the high voltage level VH in the second period P2 of the initialization mode I-M. In an exemplary embodiment, the second voltage VSS2 may be maintained at the high voltage level VH during not only the second period P2 but also the initialization mode I-M, i.e., until the driving mode D-M is started.

In an exemplary embodiment, the third transistor TR3 may be connected to a separate initial voltage terminal other than the second voltage terminal V2. The initial voltage terminal may be provided with a signal having a high level only in the second period P2 in the initialization mode I-M and having a low level in the remaining periods.

According to an exemplary embodiment as described above, even when the loading time of the timing controller 120 is increased, a noise image may be prevented from being displayed on the display panel 110.

The gate driving circuit in the display device having the configuration described above may discharge gate lines in the floating state during the initialization mode after being powered up. Accordingly, switching transistors in the pixels may remain turned off during the initialization mode, thereby preventing a noise image from being displayed.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A gate driving circuit comprising:

a plurality of driving stages, each of the plurality of driving stages configured to provide a gate signal to a corresponding gate line among a plurality of gate lines, wherein each of the plurality of driving stages comprises:

a first transistor electrically connected between a first clock terminal and a gate output terminal, the first transistor comprising a gate electrode electrically connected to a first node, the first clock terminal to receive a first clock signal;

a second transistor configured to transmit a first carry signal to the first node; and a third transistor electrically connected between the first node and a first voltage terminal, the third transistor comprising a gate electrode electrically connected to the first voltage terminal, the first voltage terminal to receive a first voltage, wherein the gate output terminal is electrically connected to the corresponding gate line, wherein each of the plurality of driving stages further comprises a fourth transistor connected between the gate output terminal and a second voltage terminal for receiving a second voltage different from the first voltage, the fourth transistor comprising a gate electrode connected to a second clock terminal for receiving a second clock signal different from the first clock signal, wherein the first voltage is changed from a first level to a second level different from the first level during an initialization mode, and wherein when the first voltage is changed to have the second level, the third transistor and the first transistor are turned on, respectively.

2. The gate driving circuit of claim 1, wherein the first voltage is changed to sequentially have the first level, the second level, and the first level during an initialization mode.

3. The gate driving circuit of claim 2, wherein the first clock signal has a low level during the initialization mode.

4. The gate driving circuit of claim 2, wherein the third transistor is configured to transmit the first voltage to the first node when the first voltage has the second level.

5. The gate driving circuit of claim 1, wherein:

each of the plurality of driving stages further comprises a fifth transistor connected between the first clock terminal and a carry output terminal, the fifth transistor comprising a gate electrode connected to the first node, and the carry output terminal is configured to output a carry signal.

6. A display device comprising:

a display panel comprising a plurality of pixels respectively connected to a plurality of data lines and respectively connected to a plurality of gate lines;

a data driving circuit configured to drive the plurality of data lines;

a gate driving circuit configured to drive the plurality of gate lines;

a timing controller configured to receive an image signal and a control signal, control the data driving circuit and the gate driving circuit to display an image on the display panel, and output a gate pulse signal; and a voltage generating circuit configured to output a first clock signal and a first voltage in response to the gate pulse signal, wherein the voltage generating circuit is configured to change the first voltage such that the first voltage sequentially has a first level and a second level different from the first level during an initialization mode, and the gate driving circuit comprises a plurality of driving stages, each of the plurality of driving stages configured to provide a gate signal to a corresponding gate line among the plurality of gate lines, wherein each of the plurality of driving stages is configured to discharge the corresponding gate line in response to the first voltage and the first clock signal during the initialization mode, wherein each of the plurality of driving stages comprises:

a first transistor connected between a first clock terminal for receiving the first clock signal and a gate output terminal, the first transistor comprising a gate electrode connected to a first node;

a second transistor configured to transmit a first carry signal to the first node; and a third transistor connected between the first node and a first voltage terminal for receiving the first voltage, the third transistor comprising a gate electrode connected to the first voltage terminal, wherein each of the plurality of driving stages further comprises a fourth transistor connected between the gate output terminal and a second voltage terminal for receiving a second voltage different from the first voltage, the fourth transistor comprising a gate electrode connected to a second clock terminal for receiving a second clock signal different from the first clock signal, wherein when the first voltage is changed to have the second level, the third transistor and the first transistor are turned on, respectively.

7. The display device of claim 6, wherein the first voltage is changed to sequentially have the first level, the second level, and the first level during the initialization mode.

8. The display device of claim 6, wherein the third transistor is configured to transmit the first voltage to the first node when the first voltage has the second level.

9. The display device of claim 6, wherein the voltage generating circuit is further configured to generate the second clock signal different from the first clock signal and the second voltage different from the first voltage.

10. The display device of claim 9, wherein the voltage generating circuit is configured to maintain the first clock signal and the second clock signal at a low level during the initialization mode.

11. The display device of claim 9, wherein the voltage generating circuit is configured to maintain the second voltage at the first level during the initialization mode.

12. The display device of claim 6, wherein:

each of the plurality of driving stages further comprises a fifth transistor connected between the first clock terminal and a carry output terminal, the fifth transistor comprising a gate electrode connected to the first node, and the carry output terminal is configured to output a carry signal.

13. The display device of claim 12, wherein the carry signal outputted from a j-th driving stage among the plurality of driving stages is provided to a carry input terminal of a (j+1)-th driving stage, wherein, j is a natural number.

14. The display device of claim 13, wherein the timing controller is configured to provide a start signal to the gate driving circuit during a driving mode.

15. The display device of claim 14, wherein a first driving stage among the plurality of driving stages of the gate driving circuit is configured to receive the start signal through a carry input terminal.

* * * * *